United States Patent [19]

Bisey

[11] 4,026,175

[45] May 31, 1977

[54] TABLE SAW WOOD EDGING ALIGNMENT TOOL

[76] Inventor: Robert P. Bisey, 2339 Spruce St., Seaford, N.Y. 11783

[22] Filed: Aug. 24, 1976

[21] Appl. No.: 717,042

[52] U.S. Cl. ..... 83/442; 144/253 R

[51] Int. Cl.[2] ..... B27B 5/04

[58] Field of Search ..... 83/442, 438, 648; 144/253 B, 253 R

[56] References Cited

UNITED STATES PATENTS 1,653,936 12/1927 Wagner ..... 83/442

3,587,680 6/1971 Bishop, Jr. ..... 83/442 X

*Primary Examiner*—Frank T. Yost

[57] ABSTRACT

An edging alignment tool resting atop a piece of wood to be edged is adjusted until the edge of an alignment bar coincides with the line on the piece of wood along which it is desired to cut. A gripping surface on the underside of the alignment tool is pressed into abrasive contact with the piece of wood. The alignment bar is moved out of the way and a guide rail is slid along the saw fence. The piece of wood is severed by the saw along the line indicated by the alignment bar.

6 Claims, 3 Drawing Figures

FIG. 1
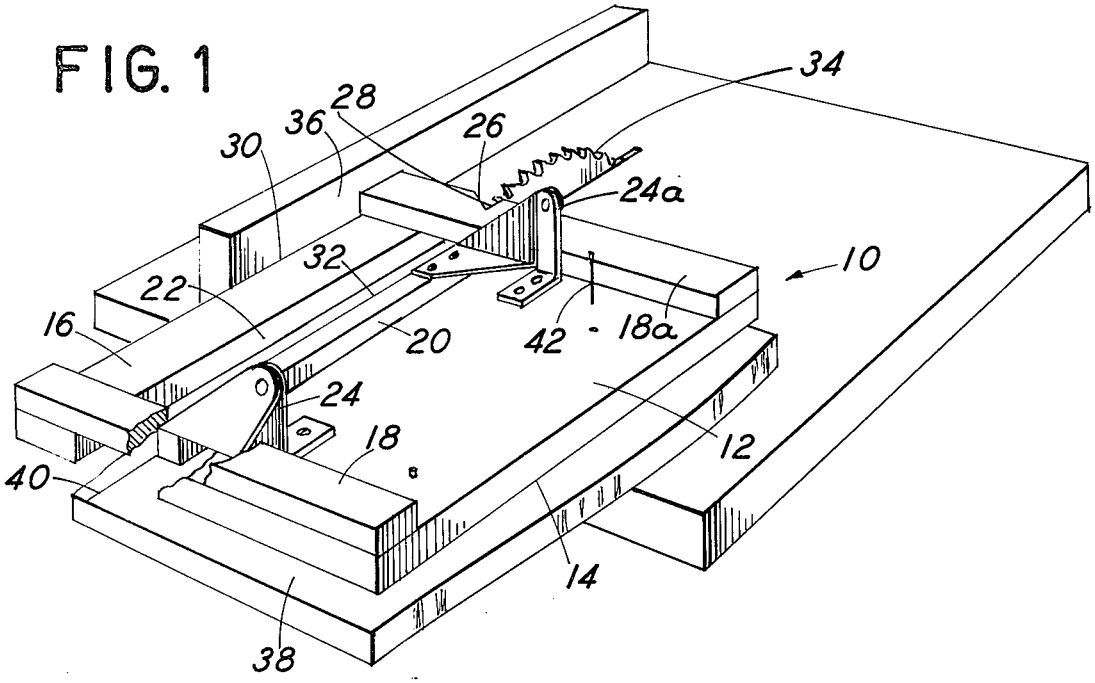
FIG. 2
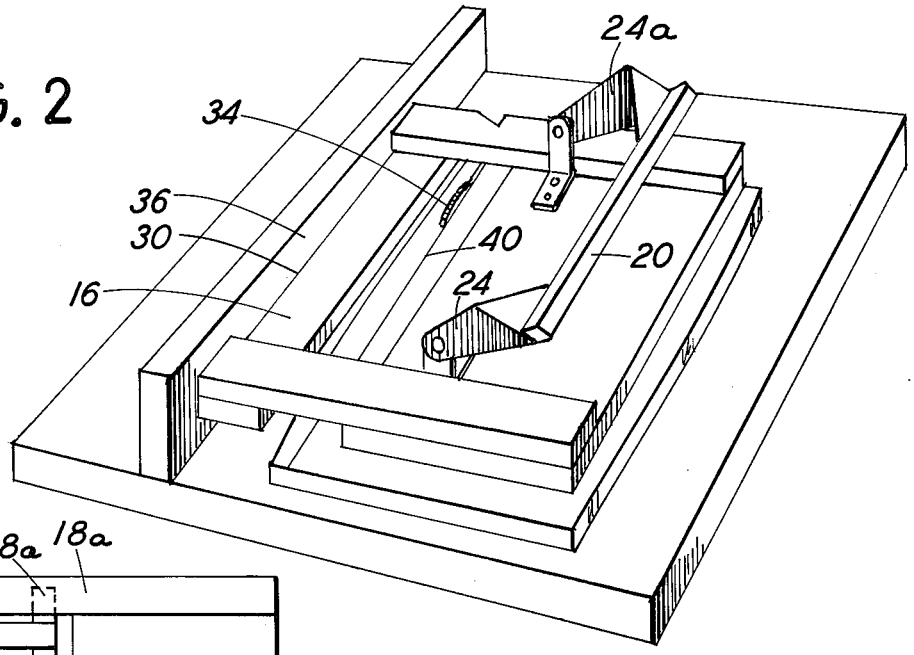
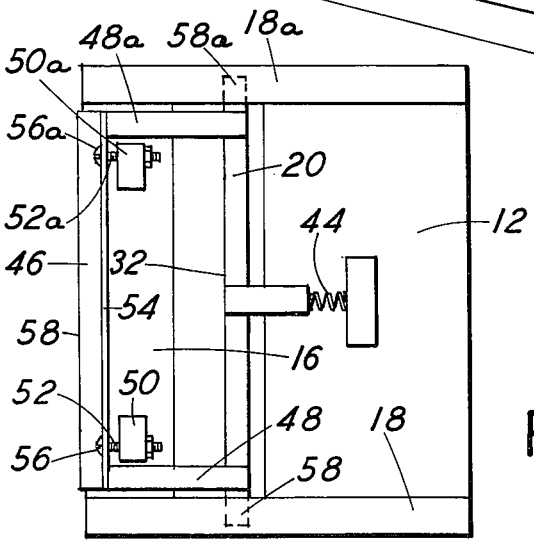
FIG. 3

TABLE SAW WOOD EDGING ALIGNMENT TOOL

BACKGROUND OF THE INVENTION

The squaring of a piece of wood having irregular edges poses the difficulty of obtaining a first square side without the aid of a means for guiding the wood along the saw fence of a conventional table circular saw.

The prior art fails to disclose a temporary guide which can be abrasively attached to the piece of wood to be squared.

SUMMARY OF THE INVENTION

The present invention teaches an edging tool suitable for use with a table circular saw. The edging tool has a movable alignment bar which is aligned with a selected line on a piece of wood to be squared. An abrasive surface on the underside of a holding piece is pressed into non-sliding abrasive contact with the piece of wood. A guide rail is extended past the edge of the piece of wood by connecting bars which join the holding piece and the guide rail. When a guide surface on the guide rail is slid along the saw fence of the table saw, the piece of wood is carried along by the holding piece. The circular saw blade cuts along the desired line on the piece of wood to be squared. The movable alignment bar is moved out of the way of the circular saw blade before cutting. In one embodiment, the movable alignment bar is rotated out of the way on hinges. In a second embodiment the movable alignment bar translated out of the way by interference of an attached spring loaded sensor shoe with the saw fence. A guide notch in one of the connecting bars is engaged in the side of the stationary circular saw blade to adjust the saw fence.

BRIEF DESCRIPTION OF THE DRAWINGS

FIG. 1 shows a perspective view of one embodiment of the invention with the hinged alignment bar in one position, FIG. 2 shows the embodiment of FIG. 1 with the alignment bar rotated into its second position; and FIG. 3 shows a top view of a second embodiment of the invention.

DETAILED DESCRIPTION OF THE PREFERRED EMBODIMENT

Referring to FIG. 1, the alignment tool, shown generally at 10 consists of a holding piece 12 having an abrasive under surface 14, a guide rail 16 connected to the holding piece 12 by a pair of connecting bars **18, 18*a*. An alignment 20 is supported in the gap 22 between the holding piece 12 and the guide rail 16 by a pair of hinges 24, 24*a*. A guide notch 26, having a guide edge 28 at the same distance from the guide surface 30 of the guide rail 16 as the outer edge 32 of the alignment bar 20 is placed against the side of the stopped table saw blade 34. The table saw fence 36 is then adjusted until it is in contact with the guide surface 30 of the guide rail 16**.

The alignment tool is placed over a piece of wood 38 which it is desired to square. The outer edge 32 of the alignment bar 20 is aligned with a pencil mark 40 or other line on the piece of wood 38 along which a cut is to be made. The holding piece 12 is then pressed down on the piece of wood 38 in order that the abrasive under surface 14 will abrasively retain non slipping relationship between the holding piece 12 and the piece of wood 38. In some cases, at least one nail 42 may be driven through the holding piece 12 part away into the piece of wood 38 to maintain non slipping relationship between them.

The alignment bar 20 is hinged out of the way as shown in FIG. 2 in order to prevent marring it. The circular saw blade 34 is lowered so that it will pass under the connecting bar **18, 18*a*. The guide surface 30 of the guide rail 16 is slid along in contact with the table saw fence 36. The saw blade 34 is thus guided to cut along the desired line 40**.

In the second embodiment, shown in FIG. 3, the alignment bar 20 is translated out of the way rather than rotated out of the way. A compression spring 44 of negligible force urges the alignment bar 20 leftward. A sensor shoe 46 is connected to the alignment bar 20 by a pair of bars **48, 48*a*. A pair of stop blocks 50, 50*a*, having bolts 52, 52*a* protruding horizontally therefrom are attached to the guide rail 16. The bolts 52, 52*a* pass loosely through a web 54 on the sensor shoe 46. Bolt heads 56, 56*a* on the bolts 52, 52*a* captivate the web 54 and prevent leftward movement thereof. A pair of guide tabs 58, 58*a* which extend outward under the connecting bars 18, 18*a* hold down the inner end of the bars 48, 48*a***.

Attachment of the second embodiment of the invention to the piece of wood to be squared is performed exactly as outlined in preceding paragraphs. When the outer edge 32 of the guide rail 16 is pressed against the saw fence 36, the sensor shoe 46 is pressed back until its forward edge 58 is aligned with the outer edge of the guide rail 16. This presses the alignment bar 20 rightward against the negligible force of the compression spring 44. Thus the alignment bar 20 is moved out of the way of the circular saw blade 34.

It will be understood that the claims are intended to cover all changes and modifications of the preferred embodiments of the invention, herein chosen for the purpose of illustration which do not constitute departures from the spirit and scope of the invention.

I claim:

1. A table saw edging alignment tool for edging a piece of wood with a circular saw blade of a table saw having a fence comprising:

a. means for aligning said alignment tool with a predetermined line on said piece of wood;

b. means for non slipping attachment of said alignment tool with said piece of wood;

c. means for moving said means for aligning out of the way of said circular saw blade; and d. means for guiding said alignment tool and said piece of wood along said fence.

2. The alignment tool recited in claim 1, futher comprising:

a. at least one bar connecting said means for attachment to said means for guiding; and b. a notch in said at least one bar adapted to contact with said saw blade while it is stationary.

3. The alignment tool recited in claim 1 wherein said means for non-slipping attachment comprises:

a. a holding piece adapted to resting upon said piece of wood; and b. an abrasive under surface on said holding piece.

4. The alignment tool recited in claim 1 wherein said means for non-slipping attachment comprise:

a. a holding piece adapted to resting upon said piece of wood, and b. at least one nail through said holding piece and at least part way through said piece of wood.

5. The alignment tool recited of claim 1 wherein said means for moving is at least one hinge.

6. The alignment tool recited in claim 1 wherein said means for moving comprises:

a. a sensor shoe connected to said means for aligning;

b. a spring of negligible force urging said means for aligning and said sensor shoe in a first direction; and c. means for translating said sensor shoe and said means for aligning against the negligible force of said spring when said sensor shoe contacts said fence.

* * * * *